US008801216B2

(12) United States Patent
Morton

(10) Patent No.: US 8,801,216 B2
(45) Date of Patent: Aug. 12, 2014

(54) LENS ASSEMBLY

(76) Inventor: Daniel Levi Morton, Vernal, UT (US)

( * ) Notice: Subject to any disclaimer, the term of this patent is extended or adjusted under 35 U.S.C. 154(b) by 0 days.

(21) Appl. No.: 13/367,055

(22) Filed: Feb. 6, 2012

(65) Prior Publication Data

US 2013/0201681 A1 Aug. 8, 2013

(51) Int. Cl.
*F21V 1/00* (2006.01)

(52) U.S. Cl.
USPC ..... 362/235; 362/294; 362/351; 362/403; 362/431; 362/523

(58) Field of Classification Search
USPC ..... 362/235, 285, 287, 294, 319, 320, 351, 362/352, 373, 403, 418, 419, 431, 449, 450, 362/523; 52/111
See application file for complete search history.

(56) References Cited

U.S. PATENT DOCUMENTS

| | | | | |
|---|---|---|---|---|
| 346,897 | A | 8/1886 | Crawford | |
| 3,860,903 | A | 1/1975 | Van Steenhoven | |
| 4,220,981 | A | 9/1980 | Koether | |
| 4,423,471 | A | 12/1983 | Gordin | |
| 4,549,252 | A | 10/1985 | Ripley | |
| RE36,414 | E | 11/1999 | Tickner | |
| 5,980,070 | A * | 11/1999 | Hulse et al. | 362/385 |
| 6,547,423 | B2 | 4/2003 | Marshall | |
| 6,601,972 | B2 | 8/2003 | Sei et al. | |
| 7,178,941 | B2 | 2/2007 | Roberge et al. | |
| 7,207,695 | B2 | 4/2007 | Coushaine | |
| 7,246,913 | B2 | 7/2007 | Ossolinski | |
| 7,344,279 | B2 | 3/2008 | Mueller et al. | |
| 7,513,802 | B2 | 4/2009 | Tufano et al. | |
| 7,524,083 | B2 | 4/2009 | Sandoval | |
| 7,641,351 | B2 | 1/2010 | Girolami | |
| 7,748,886 | B2 | 7/2010 | Pazula et al. | |
| 7,824,079 | B2 | 11/2010 | Cuppett et al. | |
| 2005/0072704 | A1 | 4/2005 | Patz et al. | |
| 2005/0259419 | A1 | 11/2005 | Sandoval | |
| 2006/0109641 | A1 | 5/2006 | Fong | |
| 2009/0052194 | A1 * | 2/2009 | Jowid | 362/351 |
| 2009/0237950 | A1 | 9/2009 | Ying | |
| 2011/0085320 | A1 | 4/2011 | Cogliano | |
| 2011/0182066 | A1 | 7/2011 | Webb | |
| 2011/0211342 | A1 | 9/2011 | Sandoval | |

FOREIGN PATENT DOCUMENTS

WO PCT/US2012/036965 8/2012

* cited by examiner

*Primary Examiner* — Meghan Dunwiddie
(74) *Attorney, Agent, or Firm* — Workman Nydegger

(57) ABSTRACT

In one example implementation, a lens assembly is provided that includes a substantially rigid lens, one or more lighting elements, and a lens cover that cooperates with the substantially rigid lens to at least partly define an enclosure within which the one or more lighting elements are disposed, wherein the lens cover is substantially non-transparent.

32 Claims, 9 Drawing Sheets

LENS ASSEMBLY

RELATED APPLICATIONS

None.

FIELD OF THE INVENTION

The present invention generally relates to lighting systems and devices, and associated components.

BACKGROUND

Lighting devices and associated components may be subjected to a variety of operating, environmental, and other conditions that can have adverse effects on the integrity and operation of such devices and components. Examples of such conditions may include conditions that can occur outdoors, such as high winds, and extreme hot and cold temperatures. As well, such lighting devices and associated components may have undesirable lighting characteristics that impair their effectiveness. Finally, the configuration of these lighting devices and associated components may be such that they have only limited usefulness in some applications.

BRIEF SUMMARY OF SOME ASPECTS OF EXAMPLE EMBODIMENTS

It should be noted that the embodiments disclosed herein do not constitute an exhaustive summary of all possible embodiments, nor does this brief summary constitute an exhaustive list of all aspects of any particular embodiment(s). Rather, this brief summary simply presents selected aspects of some example embodiments. It should be noted that nothing herein should be construed as constituting an essential or indispensable element of any invention or embodiment. Rather, various aspects of the disclosed embodiments may be combined in a variety of ways so as to define yet further embodiments. Such further embodiments are considered as being within the scope of this disclosure. As well, none of the embodiments embraced within the scope of this disclosure should be construed as resolving, or being limited to the resolution of, any particular problem(s). Nor should such embodiments be construed to implement, or be limited to implementation of, any particular technical effect(s) or solution(s).

Disclosed embodiments are generally concerned with lighting devices and associated components. Example embodiments of lighting devices within the scope of this disclosure include lens assemblies. Embodiments within the scope of this disclosure may include any one or more of the following elements, in any combination: a translucent lens; a lens comprising plastic; a substantially rigid lens; a lens that consists of a single piece of material; a lens implemented as a unitary structure; a lens substantially in the shape of a bowl and open at the top; a lens having a shape that is elliptical, parabolic, or spherical, or a portion of any of these; a lens that includes a surface treated to provide a desired lighting effect; a lens having a surface treated to reduce glare; a lens having an anti-glare surface; a lens having a frosted surface; a lens having a reflective surface; a lens that is clear; a portable light tower; a lens within which one or more light transmitting elements are partially, or completely, disposed; a single lens that provides both reflection and illumination; a lens whose diameter is greater than its depth; a mast which may or may not fold or telescope; a light stem configured to receive one or more light transmitting elements; a light stem including one or more light sockets; a light socket disposed at an angle of about 45 degrees relative to a light stem; a light transmitting element comprising a metal halide bulb; a light stem configured to be connected to a lens; a mounting element, that may or may not be ventilated, configured to enable attachment of a light stem to a lens; a lens cover that may or may not comprise metal; a ventilated lens ring; a lens ring configured to connect to one or both of a lens and lens cover; a lighting device that includes a lens having a substantially planar lens cover; a lighting device that employs only natural ventilation; a lens cover that is substantially non-transparent; a lighting device that does not require forced ventilation; a naturally ventilated lighting device; a lighting device that provides up to 360 degrees of illumination; a fan and/or other cooling device(s) configured and arranged to provide forced cooling, such as by a flow of air for example, to the interior of the lens and/or other portions of the lens assembly; and, a thermostat and/or other controls for controlling the operation of a device such as a fan.

Below, further example embodiments are set forth. Aspects of any one or more of such embodiments may be combined, in any combination, to define still further embodiments, and the embodiments set forth below may additionally, or alternatively, include one or more of the elements noted above.

In one example embodiment, a lens assembly is provided that may include a substantially rigid lens, one or more lighting elements, and a lens cover that cooperates with the substantially rigid lens to at least partly define an enclosure within which the one or more lighting elements are disposed, wherein the lens cover is substantially non-transparent.

In a second example embodiment, a lens assembly is provided that may include a substantially rigid lens implemented as a single piece of material, one or more lighting elements, and a generally planar lens cover that cooperates with the substantially rigid lens to at least partly define an enclosure within which the one or more lighting elements are disposed, wherein the lens assembly is configured to be cooled without the use of forced air flow.

In a third example embodiment, a lens assembly is provided that may include a substantially rigid lens implemented as a single piece of plastic material, one or more lighting elements, a light stem connected to the substantially rigid lens and configured to removably receive the one or more lighting elements, a perforated lens ring configured to connect to a perimeter of the substantially rigid lens, and a generally planar lens cover that is connected to the perforated lens ring and cooperates with the substantially rigid lens to at least partly define an enclosure within which the one or more lighting elements are disposed, wherein the generally planar lens covers is substantially non-transmissive to light.

These and other aspects of example embodiments of the present invention will become more fully apparent from the following brief description of the drawings, the drawings themselves and the appended claims.

BRIEF DESCRIPTION OF THE DRAWINGS

The appended drawings contain figures of example embodiments to further illustrate and clarify various aspects of the present invention. It will be appreciated that these drawings depict only example embodiments of the invention and are not intended to limit the scope of the invention in any way. The invention will be described and explained with additional specificity and detail through the use of the accompanying drawings in which.

DETAILED DESCRIPTION OF ASPECTS OF SOME EXAMPLE EMBODIMENTS

Figure 1:
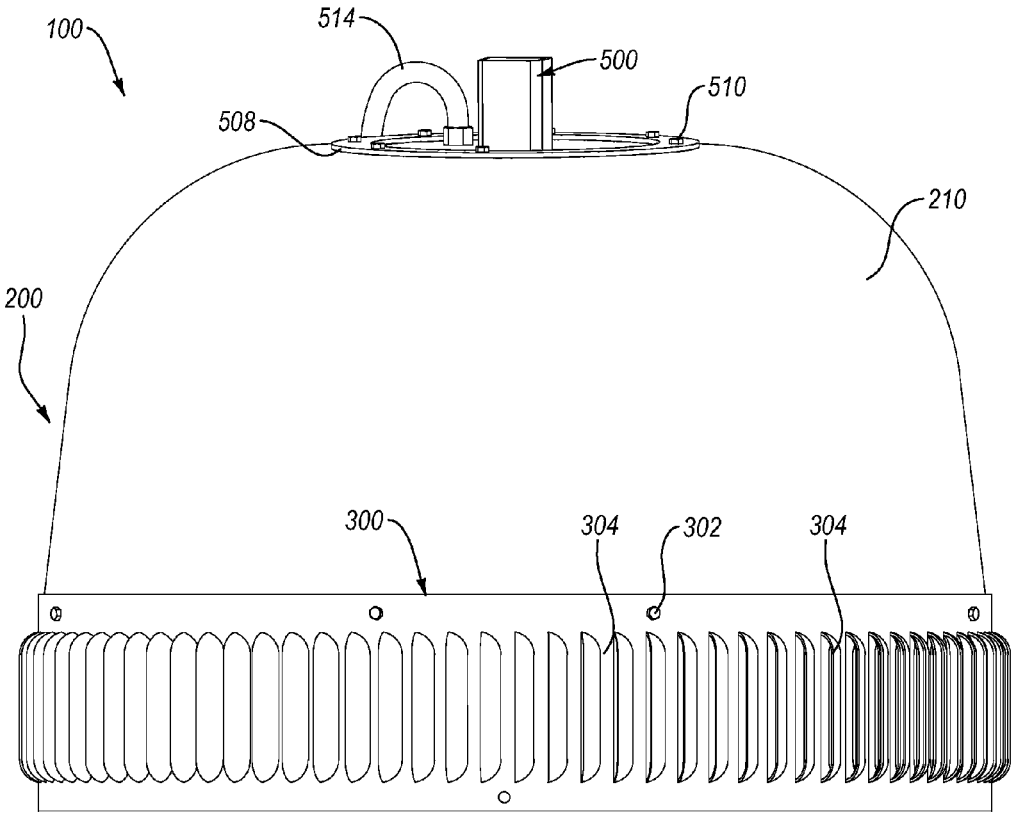
FIG. 1 is a side view of an example embodiment of a lens assembly, and discloses a lens, light stem and perforated lens ring.
Figure 2:
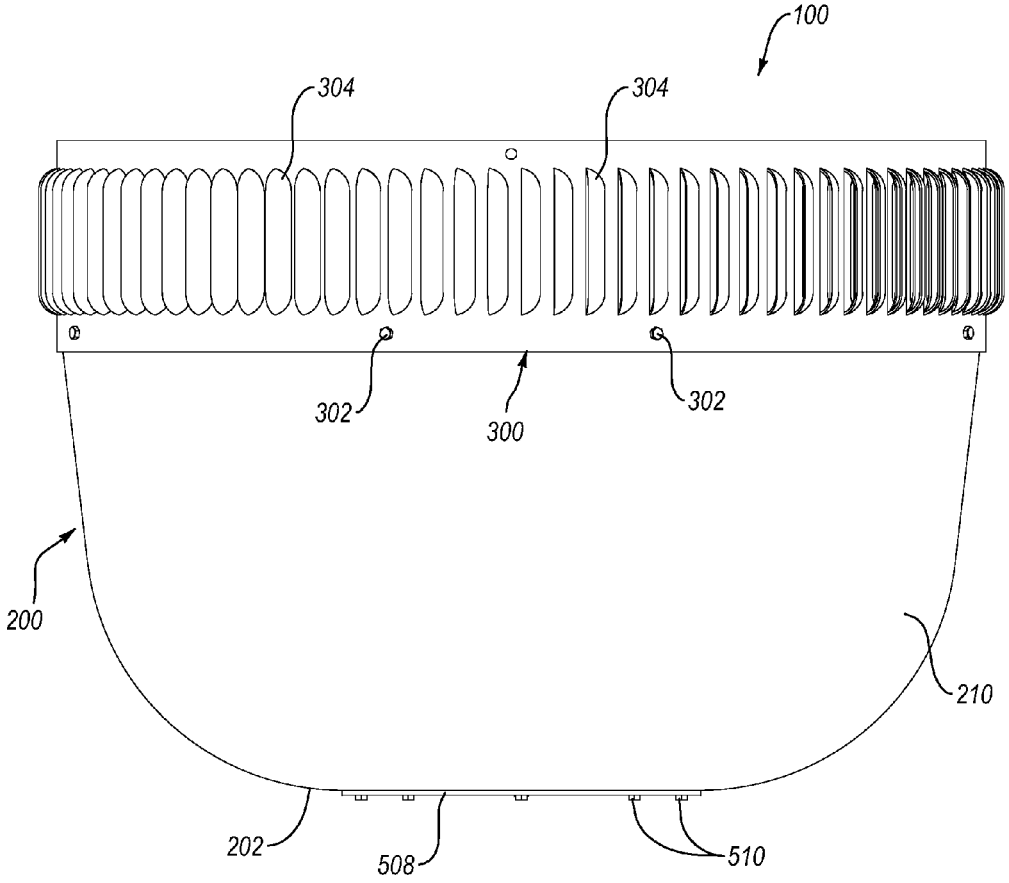
FIG. 2 is a side view of the example embodiment of FIG. 1, and discloses a lens and perforated lens ring.
Figure 3:
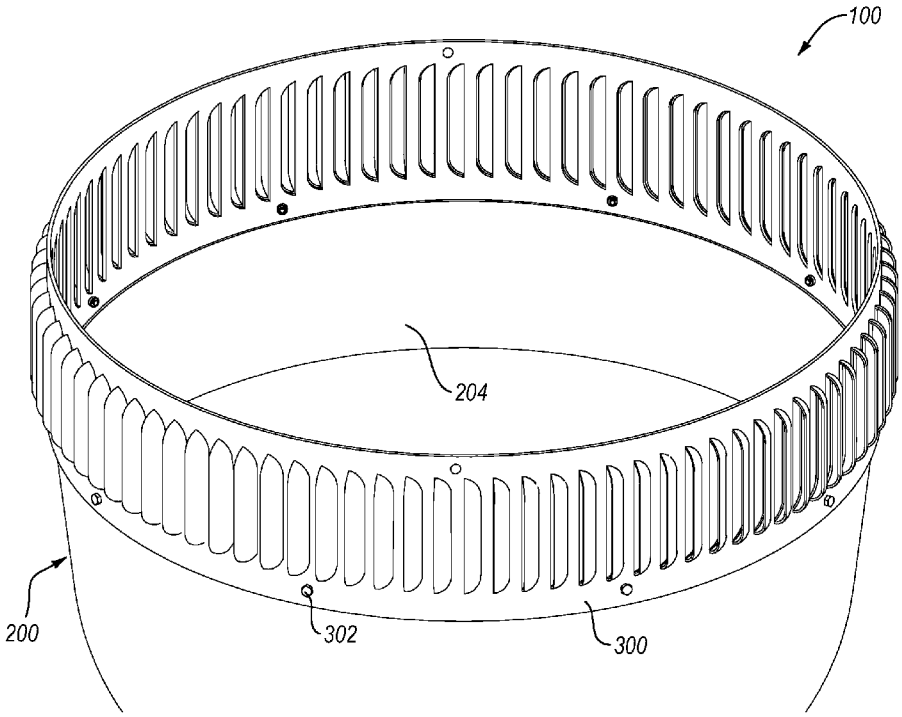
FIG. 3 is a partial view of the interior of a lens of a lens assembly, and discloses a perforated lens ring.
Figure 4:
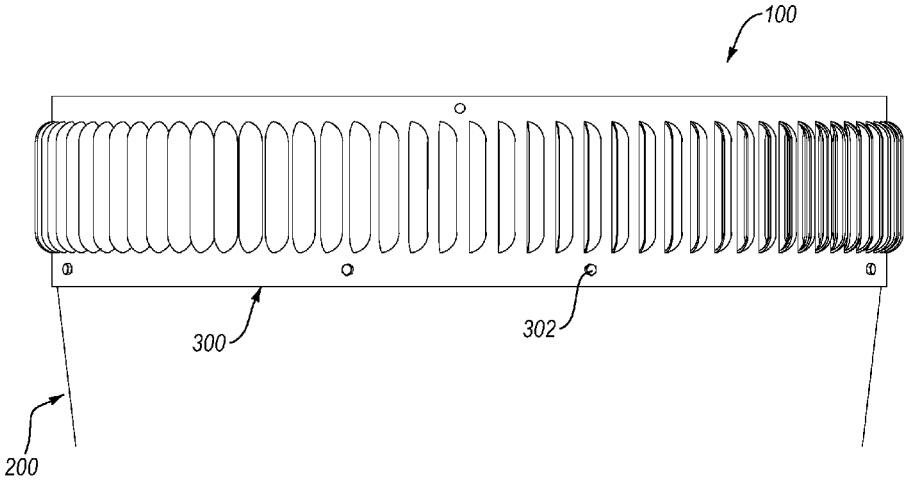
FIG. 4 is a partial side view of a lens assembly, and discloses a lens and perforated lens ring.

As noted above, embodiments within the scope of the present invention generally relate to a lens assembly, and associated equipment and components. One or more aspects of example embodiments may also find application in equipment such as, but not limited to, light towers such as may be employed at construction sites. A discussion of various aspects of components of example embodiments is set forth below.

In general, one example embodiment of a lens assembly may include, among other things, a lens, one or more lighting elements, a light stem, a lens ring, and a lens cover. However, and as noted above, other embodiments within the scope of this disclosure may include more, fewer, and/or alternative elements.

In the examples disclosed in the Figures, a lens assembly 100 is provided that includes a lens 200 to which a lens ring 300 is attached. A lens cover 400 cooperates with the lens ring 300 and the lens 200 to define an enclosure within which one or more lighting elements, supported by a light stem 500, are disposed. Following is a discussion of the components in this example embodiment.

Lens

With particular attention now to FIGS. 1, 3, 4 and 6, an example lens assembly 100 is disclosed that may include a lens 200. In general, the lens 200 is at least partially translucent so that light within the interior of the lens 200 can pass through the lens 200 to the exterior. The lens 200 may be constructed of any suitable materials. Example lens materials include plastic, glass, fiberglass and combinations thereof. In some particular example embodiments, the lens 200 may substantially comprise polycarbonate and/or polyvinylchloride (PVC). Any other material(s) of suitable physical, chemical, and optical properties may likewise be employed.

Embodiments of a lens, including lens 200, may be produced by any suitable method, or methods. Example methods which may be employed in the production of a lens include injection molding. However, any other suitable method(s) may alternatively be employed, and the scope of the invention is not limited to any particular production method, or methods.

Depending upon considerations such as the intended application, and operating environment, embodiments of the lens 200 may have various physical properties which, as noted above, may be combined in a variety of ways to define various embodiments. For example, in at least some embodiments, the lens 200 is substantially rigid. As another example, the lens 200 may be implemented as a unitary structure that comprises a single piece of material. The physical and/or optical properties of the lens may be substantially homogeneous throughout the lens. Alternatively, the physical and/or optical properties may be different in different parts of the lens. For example, the wall thickness of the lens 200 may vary throughout the lens 200. As another example, some portions of the lens 200 may be relatively more transmissive to light than other portions of the lens 200.

As well, some embodiments of the lens 200 may be substantially in the shape of a bowl. The shape of the bowl may be generally elliptical, parabolic, spherical, or a combination of one or more of these. As well, the perimeter of the bowl may be generally circular, polygonal, or some other shape. As indicated in FIG. 1 for example, the lens 200 may be flat on the bottom 202. In one example embodiment, the width of a bowl shaped lens may be greater than the depth of the bowl shaped lens. In a more specific example, the width, or diameter, of a bowl shaped lens may be about 36 inches, while the depth of that bowl shaped lens may be about 20 inches. This example ratio of lens diameter to depth can be extrapolated to define bowl shaped lenses of other sizes.

In another example, the width of a bowl shaped lens may be less than the depth of the bowl shaped lens while, in still another example, the width and depth of a bowl shaped lens may be substantially equal. As well, embodiments of the lens 200 may be sufficiently large that one or more lighting elements may reside completely within the interior 204 of the lens 200. See, e.g., FIGS. 3 and 6. Finally, the lens 200 may include an opening 206 in the bottom that is configured to receive a light stem, as discussed in further detail below. The perimeter of the opening 206 may include a reinforcement element 208, such as with a metal ring for example, to support a light stem, discussed below.

Embodiments of the lens 200 may have a variety of optical characteristics, at least some of which may be implemented through surface treatments of at least a portion of the interior 204 surface and/or the exterior 210 surface of the lens 200. By way of illustration, a portion of the interior 204 surface of the lens 200 may be covered with a reflective material, such as by painting, or the reflective material may comprise a material that is attached to the interior surface of the lens with an adhesive or a comparable material. Additionally, or alternatively, a portion of the interior 204 of the lens 200 may treated, such as by sandblasting for example, to provide a frosted surface that diffuses light and/or provides an anti-glare effect. Finally, some or all of the lens may be clear in some embodiments.

Lens Ring

With continued attention to the Figures, the example lens assembly 100 may include a lens ring 300. Embodiments of the lens ring 300 may extend about part or all of the perimeter of the lens 200. In one embodiment, the lens ring 300 is generally circular in shape, comprising a single piece of material whose two ends are attached to each other such as by welding, brazing, or with the use of fasteners. In another embodiment, the lens ring 300 is polygonal in configuration and may either comprise a plurality of elements joined together to form the lens ring, or may comprise a single piece of material bent or otherwise formed into a polygonal configuration.

The lens ring 300 may be made of metal, such as aluminum for example, and/or non-metallic materials such as plastics and composites. In the example of FIG. 1, the lens ring 300 is secured to the perimeter of the lens 200 with fasteners, such as screws, pins, bolts or rivets for example. However, any other suitable devices and/or structures for securing the lens ring 300 to the lens 200 may be employed. The lens ring 300 may be permanently, or removably, attached to the lens 200. The lens ring 300 may be perforated so as to facilitate the natural ventilation of the interior of the lens 200. Such natural ventilation may, for example, permit the escape from the lens 200 of air that has been heated by the lighting elements disposed within the lens 200.

In one particular example of a perforated lens ring, such as is disclosed in FIGS. 1-6, the lens ring 300 may include one or more vents 304, which may be substantially uniform in one or more of their size, shape, spacing, distribution, and orientation, that enable natural ventilation of the interior of the lens 200. However, it is not necessary that the vents 304 be substantially uniform in any of the aforementioned regards. While the vents 304 indicated in the Figures are generally rectangular in shape, the vents 304 may take a variety of shapes such as circular, oval, polygonal, or square, for example, and the scope of this disclosure is not limited to vents 304 of any particular size, shape, location, orientation, or geometry.

In at least some embodiments, the open area collectively defined by the one or more vents 304 is sufficient to enable the lens assembly 100 to be adequately cooled without necessitating the use of forced ventilation. Thus, any configuration of the vent(s) 304 that enables such cooling is embraced within the scope of this disclosure.

Finally, the lens ring 300 may comprise a material, such as metal noted above, that is substantially non-transparent such that little, or no, light is able to pass through the material of the lens ring 300. In other embodiments, the lens ring 300 may permit the passage of light. Where the lens ring 300 is perforated, light may pass through the perforation(s) of the lens ring 300.

Lens Cover

Figure 5:
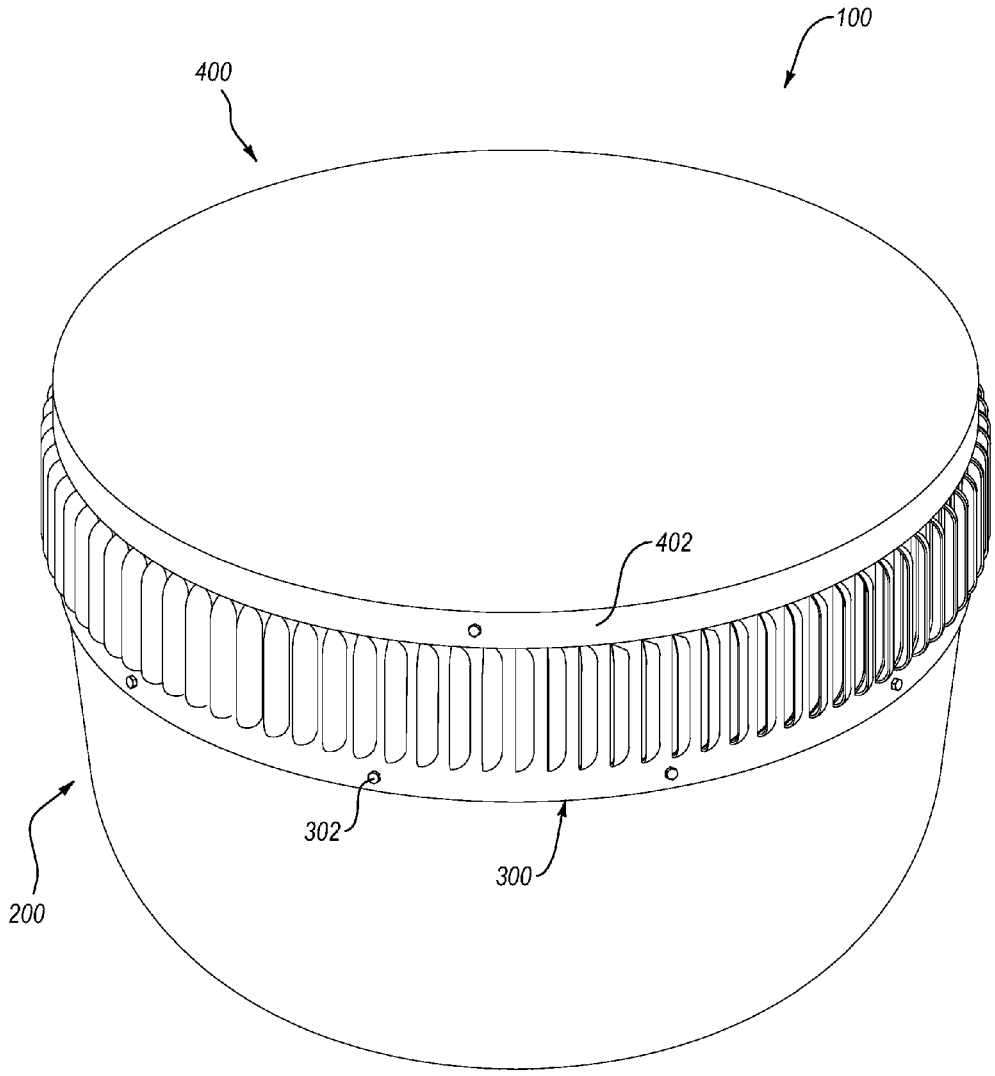
FIG. 5 is a perspective view of a lens assembly, and discloses a lens, perforated lens ring, and lens cover.
Figure 6:
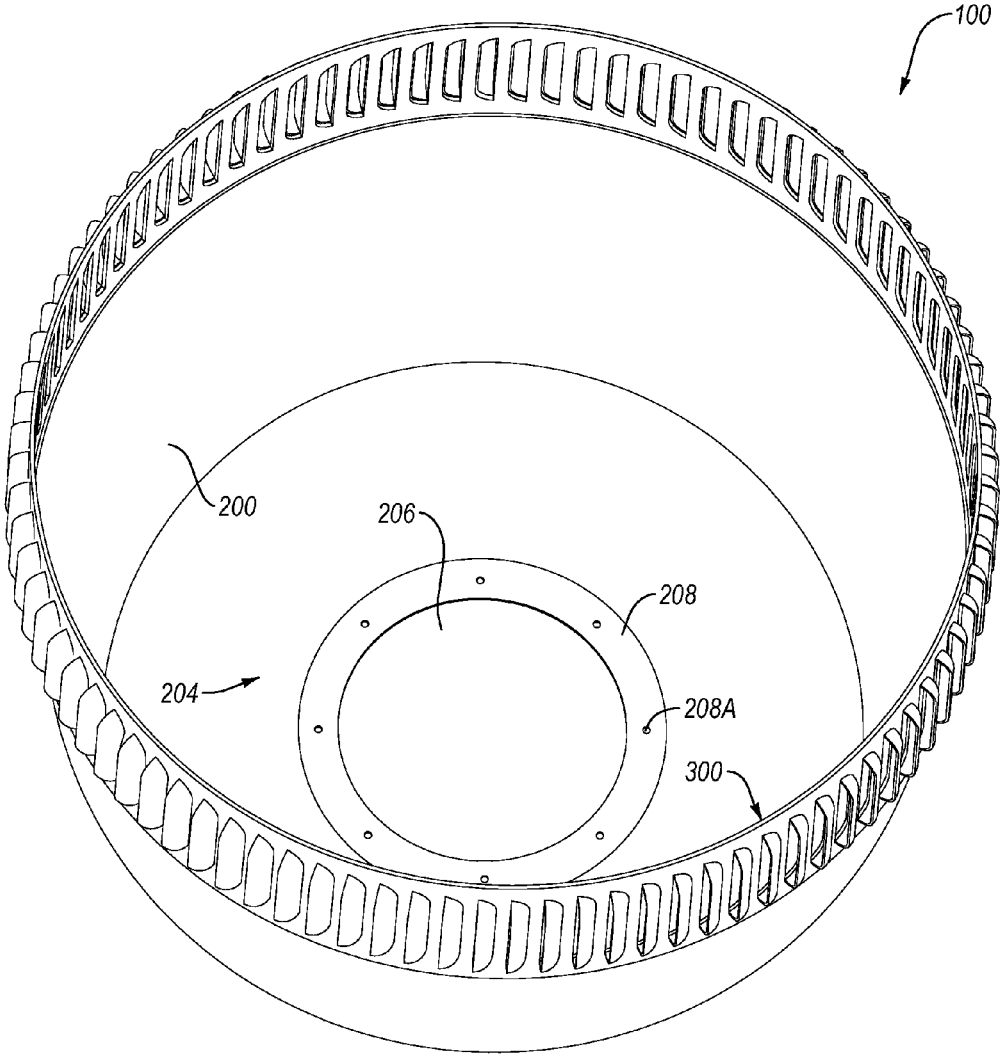
FIG. 6 is a top view of the interior of a lens assembly, and discloses a lens and perforated lens ring, as well as an opening for receipt of a light stem.
Figure 7:
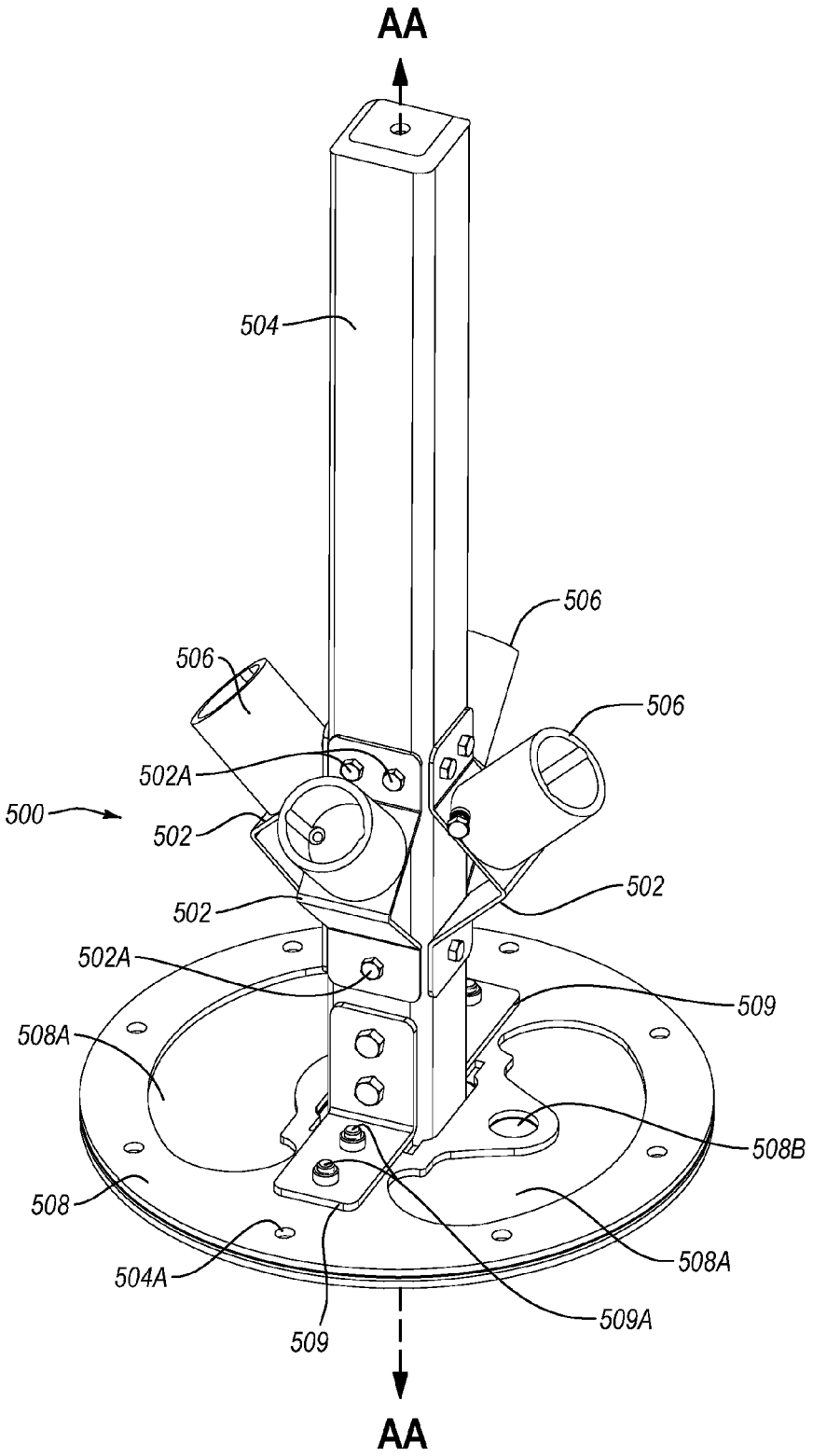
FIG. 7 is a perspective view of an example light stem.

With particular attention to FIG. 5, embodiments of the lens assembly 100 may include a lens cover 400 that cooperates with the lens ring 300 and the lens 200 to define an enclosure within which the lighting elements and a portion of the light stem (discussed below) be disposed. In some embodiments, the lens cover 400 may be made of a metal, such as aluminum for example, and/or non-metallic materials such as plastics and composites. The lens cover 400 may have an interior surface that is reflective. The interior surface may be polished metal. All, or only a portion of, the interior surface of the lens cover 400 may be reflective. In some embodiments, the interior surface of the lens cover 400 may be non-reflective.

The lens cover 400 may be a separate piece from the lens ring 300, or the two components may be integrally formed with each other. In some implementations, the lens cover 400 is secured to the lens ring 300 with fasteners such as screws for example, but any other suitable device(s) may be employed to attach the lens cover 400 to the lens ring 300. The lens cover 400 may be permanently, or removably, attached to the lens ring 300. In at least some embodiments, the lens cover 400 may generally take the form of a cap having a rim 402 that extends about the outside of the lens ring 300, although other configurations of the lens cover 400 may alternatively be employed.

In at least some embodiments, the lens cover 400 is substantially non-transparent such that little, or no, light is able to pass through the lens cover 400. In other embodiments, the lens cover 400 may be made of a material that permits the passage of light.

Finally, the lens cover 400 may provide protection to the lighting elements and light stem 500 from the weather, dust, dirt, and impacts from objects such as rocks.

Light Stem

Figure 8:
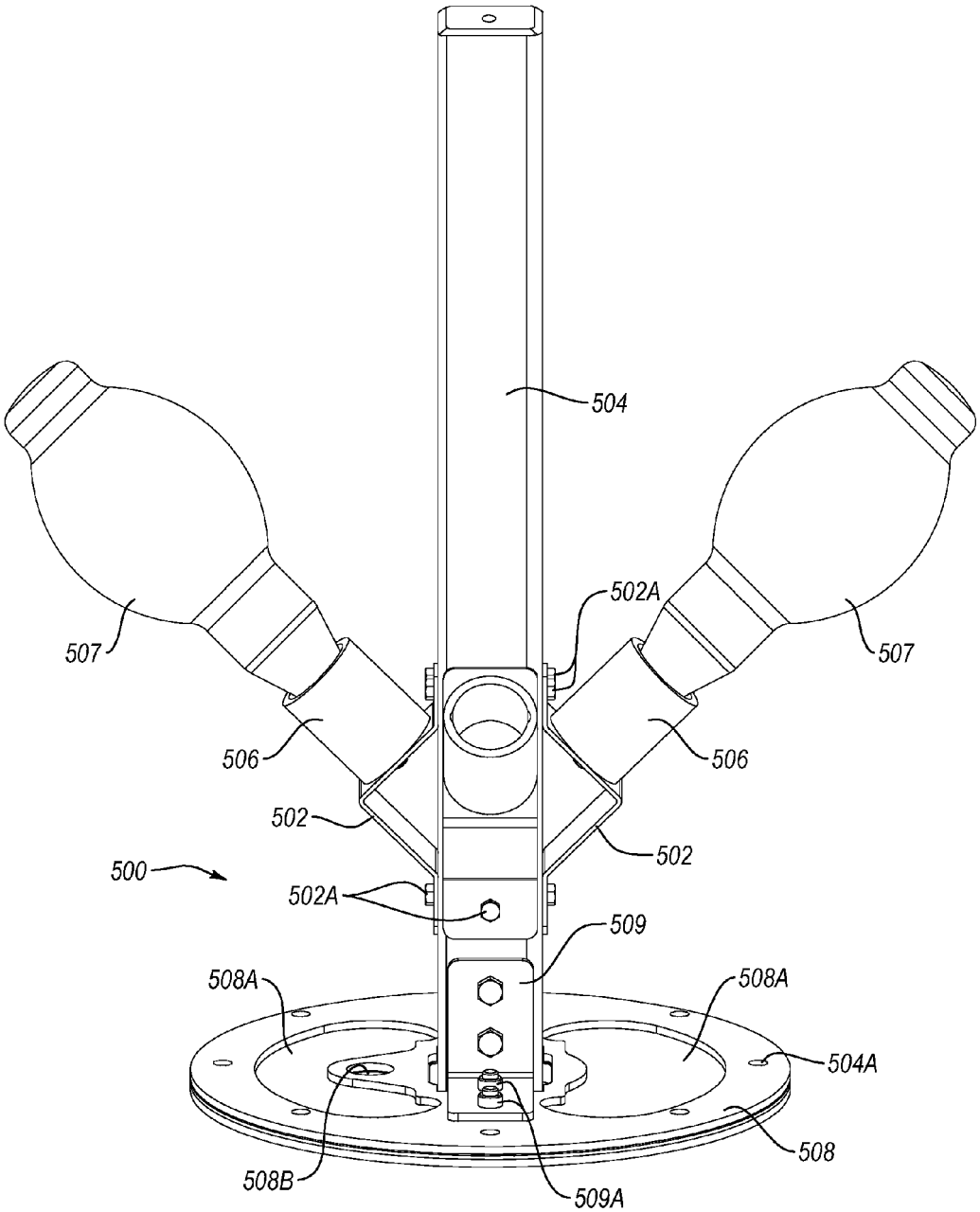
FIG. 8 is a perspective view of an example light stem.
Figure 9:
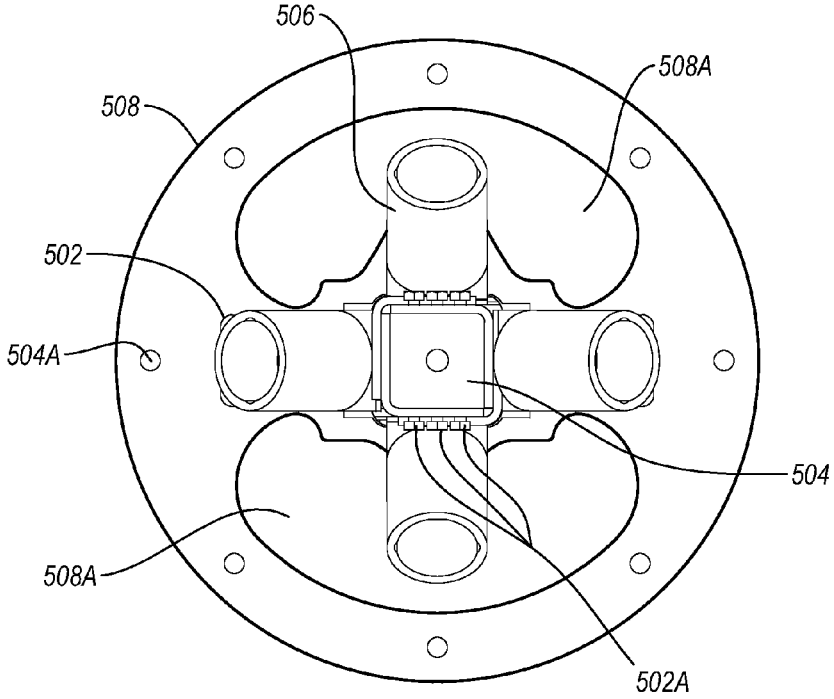
FIG. 9 is a top view of a portion of an example light stem.
Figure 10:
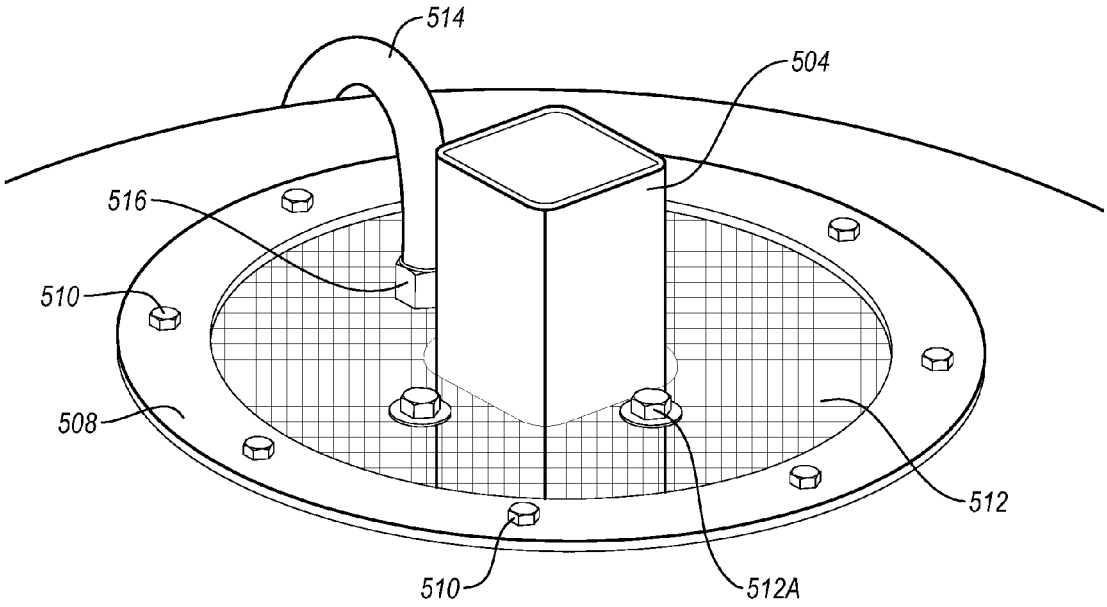
FIG. 10 is a partial perspective view, and discloses a light stem assembled together with a lens.

As noted above, and disclosed in FIGS. 8-10, for example, embodiments of the lens assembly 100 may include a light stem 500. In general, the light stem 500 is configured with one or more socket supports 502 that are attached to a stem 504. Each of the socket supports 502 supports an electrical socket 506 that is configured to provide power to, and removably receive, a corresponding lighting element 507. In the example of FIGS. 7-10, the light stem 500 includes four electrical sockets 506, although more or fewer sockets may alternatively be employed. The socket supports 502 and the stem 504 may be made of any suitable material. Examples of such materials include, but are not limited to, metals, such as aluminum or steel, and ceramic materials. As well, the socket supports 502 and/or stem 504 may be made from stock such as square or round tube or pipe, although other shapes of stock can be used, such as angled pieces of stock connected to each other in such a way as to define a generally rectangular cross-section, and solid stock may be employed as well. In the example of FIGS. 8-10, the stem 504 is made from square tube stock, and the socket supports 502 are made from half a cross-section of square tube stock. The socket supports 502 and stem 504 can be attached to each other in any suitable manner, such as by bolting, screwing, welding or brazing, for example. In some embodiments, the socket supports 502 may be attached to the stem 504 with corresponding fasteners 502A.

In at least some embodiments, the socket supports 502 are configured and arranged relative to the stem 504 such that a lighting element 507 held in the electrical socket 506 is tilted at an angle of about 45 degrees relative to a vertical axis AA defined by the stem 504, although tilt angles larger or smaller than 45 degrees may be employed. In some instances, the tilt angle can vary from one lighting element to another in a single embodiment while, in another embodiment, all of the lighting elements of that embodiment may have substantially the same tilt angle. Finally, the vertical positioning of the socket supports 502 and, thus, the vertical position of the lighting elements, can be at any desired location along the stem 504.

With continuing reference to FIGS. 7-10, the light stem 500 may include a base 508 to which the stem 504 is attached, such as by welding, brazing, bolting, or screwing, for example. In some embodiments, the base 508 may be attached to the light stem 500 by way of brackets 509 and corresponding fasteners 509A.

The base 508 may be implemented as a substantially flat plate of any suitable shape and size, and may be comprised of the same materials, noted above, as the stem 504 and socket supports 502. The base 508 may include a plurality of holes 504A which are each configured to receive a fastener 510, such as a bolt or screw for example, so as to enable removable attachment of the stem 504 to the lens 200. The holes 504A may be aligned with corresponding holes 208A of the reinforcing element 208 (see FIG. 6) so that the fasteners 510 can pass through the base 508, lens 200, and the reinforcing element 208. Among other things, the bolted construction of the base 508 enables ready removal and replacement of the light stem 500 and, thus, the lighting elements.

As further disclosed in FIGS. 7-10, the base 508 may include one or more openings 508A which may facilitate natural ventilation of the lens 200. Such openings 508A and the vents 304, individually or in combination, comprise an example structural implementation of a means for natural ventilation. Any other structure(s) of comparable functionality may alternatively be employed however, and the scope of the invention is not limited to structures having the form of the openings 508A and vents 304.

As indicated in FIG. 10, the openings 508A may be covered with a screen 512, which may comprise mesh or other suitable material, so as to inhibit the entry of foreign matter into the lens 200, and to enable moisture, for example, to escape from the lens 200. The screen 512 may be attached to the base 508 with fasteners 512A.

The base 508 may further include an additional opening 508B by way of which an electrical cable 514 can be fed into the lens 200 to supply power to the lighting elements. The additional opening can be reinforced with an element, such as a nut 516 for example.

With reference now to one specific embodiment of the light stem 500, such embodiment may include a stem 504 constructed of 2½ inch square aluminum tube, and the electrical sockets 506 may include four mogul light base sockets wired to a seven-wire electrical cord that terminates in a six-pin electrical plug. The plug may be configured to connect to a mast cord on a light tower. Four lighting elements may be provided that each comprise a 1000 watt metal halide bulb. The metal halide bulbs may run off of ballasts installed in the light tower, or located elsewhere.

Light Tower

Figure 11:
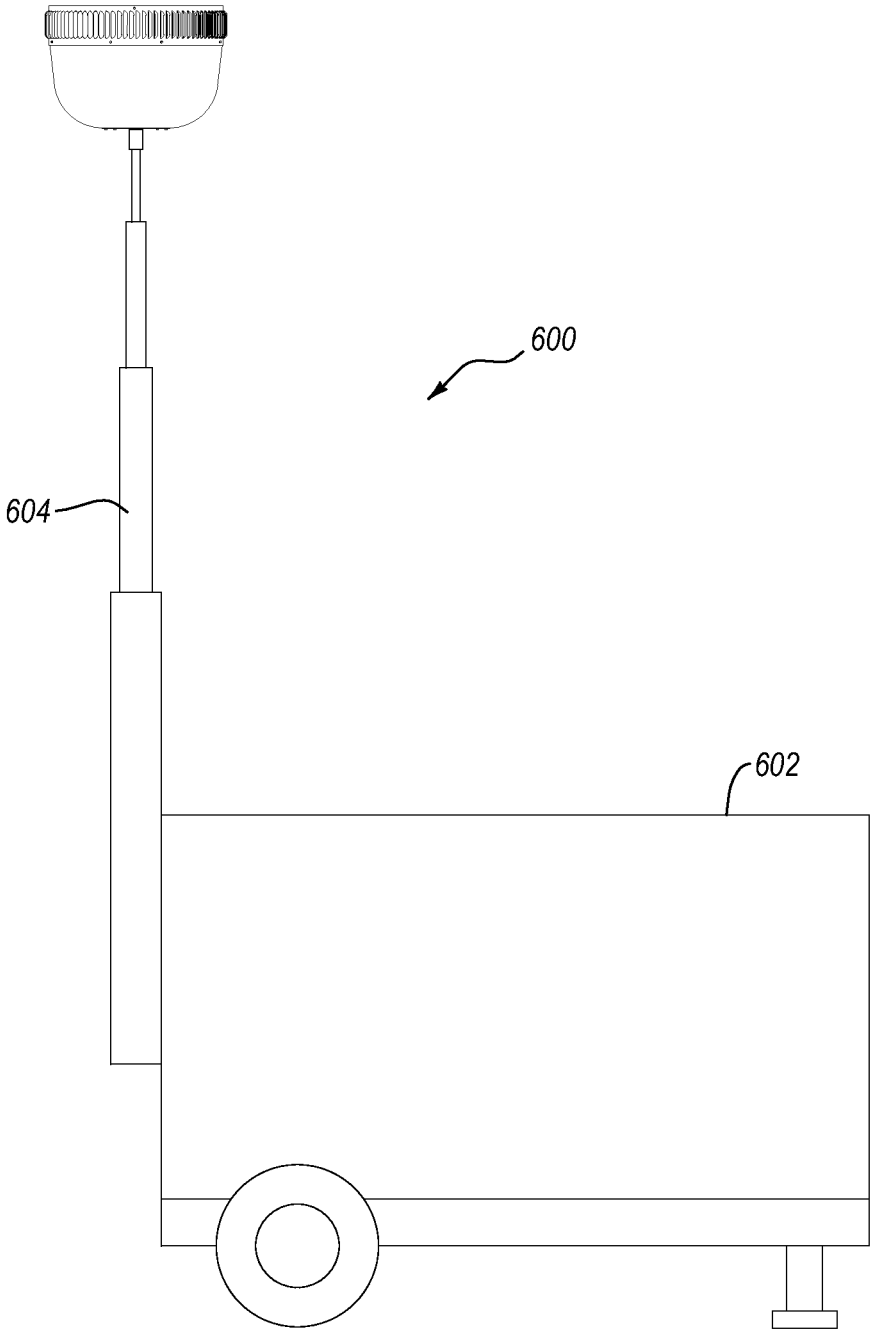
FIG. 11 is a schematic view of an example of a light tower with which a lens assembly may be employed.

As noted herein, embodiments of the lens assembly 100, or embodiments of the other components disclosed herein, may be employed in connection with a light tower. One example of such a light tower is a light tower that may be used at highway construction sites, or in other applications where portable lighting may be useful. Such a light tower may include a lens assembly, a mast to which the lens assembly is at least indirectly connected, and a portable base to which the mast is at least indirectly connected With particular attention now to FIG. 11, further details are provided concerning an example of a light tower 600. In the example embodiment of FIG. 11, the light tower 600 includes a base 602, which may be portable and include wheels and a trailer hitch. The base 602 may also include a power supply that provides power, by way of one or more cables for example, to one or more lighting elements of the lens assembly(ies) 100. The power supply may include a generator that runs on gasoline, diesel, natural gas, or other fuel. The base 602 supports a mast 604 which may have a folding and/or telescoping configuration that enables the mast 604 to assume various different positions and orientations. For example, the mast 604 may be retracted to a position suitable for transportation, and extended to a position where the light tower 600 is ready for use. The mast 604 may be constructed of metal(s), such as aluminum or steel for example, or any other suitable materials. The mast 604 is connected, either directly or indirectly, to one or more lens assemblies 100. The number, size, arrangement, and orientation of the one or more lens assemblies 100 may be selected as desired.

The present invention may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A lens assembly, comprising:

a substantially rigid lens implemented as a single piece of material and defining an interior;

one or more lighting elements;

a light stem that extends into the interior of the substantially rigid lens and supports the one or more lighting elements;

a lens cover that cooperates with the substantially rigid lens to substantially enclose the one or more lighting elements, wherein the lens assembly is configured to be cooled without the use of forced air flow; and a perforated lens ring configured to connect to a perimeter of the substantially rigid lens and to the lens cover, the perforated lens ring defining a plurality of openings in communication with the interior of the substantially rigid lens.

2. The lens assembly of claim 1, wherein the substantially rigid lens substantially comprises polyvinylchloride.

3. The lens assembly of claim 1, wherein the one or more lighting elements comprises four or more lighting elements.

4. The lens assembly of claim 1, wherein the lens cover substantially comprises metal.

5. A light tower, comprising:

the lens assembly of claim 1;

a mast to which the lens assembly is at least indirectly connected; and a portable base to which the mast is at least indirectly connected.

6. The light tower of claim 5, further comprising a generator operable to provide power to the lens assembly.

7. The lens assembly as recited in claim 1, wherein the substantially rigid lens is generally bowl shaped and comprises plastic.

8. The lens assembly as recited in claim 1, wherein a portion of the substantially rigid lens is light reflective.

9. The lens assembly as recited in claim 1, wherein a portion of the substantially rigid lens is anti-glare.

10. The lens assembly as recited in claim 1, wherein one of the lighting elements is a metal halide bulb.

11. The lens assembly as recited in claim 1, wherein the lens assembly is configured to be sufficiently cooled with only natural ventilation.

12. The lens assembly as recited in claim 1, wherein at least a portion of the substantially rigid lens is light diffusive.

13. The lens assembly as recited in claim 1, wherein the substantially rigid lens comprises polycarbonate.

14. The lens assembly as recited in claim 1, wherein the one or more lighting elements are substantially enclosed within the interior of the substantially rigid lens.

15. The lens assembly as recited in claim 1, wherein the lens cover is substantially planar.

16. The lens assembly as recited in claim 1, wherein the light stem includes one or more electrical sockets, each of which receives a respective lighting element.

17. The lens assembly as recited in claim 1, wherein the substantially rigid lens defines an opening through which the light stem extends, and the opening is substantially covered with a screen that fits around the light stem and permits ventilation of the lens interior by way of the opening.

18. A lens assembly, comprising:

a substantially rigid lens implemented as a single piece of plastic material, the substantially rigid lens being generally bowl-shaped and having a bottom in which an opening is defined;

one or more lighting elements;

a light stem extending through the opening in the bottom of the substantially rigid lens and supporting the one or more lighting elements;

a perforated lens ring configured to connect to a perimeter of the substantially rigid lens; and a generally planar lens cover that is connected to the perforated lens ring and cooperates with the substantially rigid lens and the perforated lens ring to substantially enclose the one or more lighting elements, wherein the generally planar lens cover is substantially non-transmissive to light.

19. The lens assembly as recited in claim 18, wherein the lens assembly is operable to provide about 360 degrees of illumination.

20. The lens assembly as recited in claim 18, wherein a portion of the substantially rigid lens is anti-glare.

21. The lens assembly as recited in claim 18, wherein a portion of the substantially rigid lens is treated to provide a desired lighting effect.

22. A light tower, comprising:

the lens assembly of claim 18;

a mast to which the lens assembly is at least indirectly connected; and a portable base to which the mast is at least indirectly connected.

23. The light tower of claim 22, further comprising a generator operable to provide power to the lens assembly.

24. The lens assembly as recited in claim 18, wherein the substantially rigid lens comprises polycarbonate.

25. The lens assembly as recited in claim 18, wherein a portion of the substantially rigid lens is light reflective.

26. The lens assembly as recited in claim 18, wherein one of the lighting elements is a metal halide bulb.

27. The lens assembly as recited in claim 18, wherein the lens assembly is configured to be sufficiently cooled with only natural ventilation.

28. The lens assembly of claim 18, wherein the lens cover substantially comprises metal.

29. The lens assembly as recited in claim 18, wherein at least a portion of the substantially rigid lens is light diffusive.

30. The lens assembly as recited in claim 18, wherein the one or more lighting elements are substantially enclosed within an interior of the substantially rigid lens.

31. The lens assembly as recited in claim 18, wherein the light stem includes one or more electrical sockets, each of which receives a respective lighting element.

32. The lens assembly as recited in claim 18, wherein the opening in the substantially rigid lens is substantially covered with a screen that fits around the light stem and permits ventilation of an interior of the lens by way of the opening.

* * * * *

UNITED STATES PATENT AND TRADEMARK OFFICE

CERTIFICATE OF CORRECTION

PATENT NO. : 8,801,216 B2
APPLICATION NO. : 13/367055
DATED : August 12, 2014
INVENTOR(S) : Morton It is certified that error appears in the above-identified patent and that said Letters Patent is hereby corrected as shown below:

In the Specification

Column 3
Line 6, change "of a lens of a lens" to --of a lens--

Signed and Sealed this
Fourteenth Day of July, 2015

Michelle K. Lee

Michelle K. Lee
*Director of the United States Patent and Trademark Office*